US005570795A

United States Patent [19]

Colgrove

[11] Patent Number: 5,570,795

[45] Date of Patent: Nov. 5, 1996

[54] CONFIGURABLE AND PORTABLE DISPLAY STAND

[76] Inventor: Mark Colgrove, 310 Cherry St., Oxford, N.C. 27565

[21] Appl. No.: 359,080

[22] Filed: Dec. 19, 1994

[51] Int. Cl.[6] ..... A47B 43/00; A47B 47/00; A47B 57/00

[52] U.S. Cl. ..... 211/187; 211/149; 211/190; 211/203; 211/208; 108/96

[58] Field of Search ..... 211/149, 188, 211/190, 196, 201, 203, 207, 208, 195, 186, 187, 130; 108/66, 92, 93

[56] References Cited

U.S. PATENT DOCUMENTS

| | | | |
|---|---|---|---|
| 311,408 | 1/1885 | Butcher | 211/186 X |
| 3,437,060 | 4/1969 | Giambalvo | 211/187 X |
| 4,060,275 | 11/1977 | Hansen | 297/159 |
| 4,262,439 | 4/1981 | Dinan et al. | 211/187 X |
| 4,334,482 | 6/1982 | Bolduc | 108/96 X |
| 4,746,022 | 5/1988 | Benham | 211/196 X |
| 5,363,772 | 11/1994 | Adamidis | 108/66 |

FOREIGN PATENT DOCUMENTS

| | | | |
|---|---|---|---|
| 57438 | 4/1940 | Denmark | 108/66 |
| 2544181 | 10/1984 | France | 108/66 |
| 92095 | 7/1958 | Norway | 108/66 |
| 280417 | 1/1952 | Switzerland | 211/187 |

*Primary Examiner*—Ramon O. Ramirez
*Assistant Examiner*—Brian J. Hamilla
*Attorney, Agent, or Firm*—Rhodes, Coats & Bennett, L.L.P.

[57] ABSTRACT

A display stand includes multiple support surfaces which can be configured to lie in a single plane to form a table top or in vertically spaced planes to form a multi-tiered display stand. The display stand includes a center section and one or more extensions which substantially surround the center section. The center section is supported by legs which are pivotally attached to the center section. The extensions include locking members disposed along an inner edge thereof for releasably engaging the outer edge of the center section or an adjacent inner extension. When the center section and extensions are locked together, they lie in a common plane to form a table top. When the extensions are disengaged from the center section and each other, the extensions can be lowered so as to rest on the legs in a vertically spaced relationship to one another. The height of the display stand can be adjusted by pivoting the legs inwardly and outwardly relative to the vertical axis of the display stand. A support frame is slidably connected to the legs and can be secured at selected locations along the legs to fix the legs at the selected angular position.

27 Claims, 21 Drawing Sheets

CONFIGURABLE AND PORTABLE DISPLAY STAND

FIELD OF THE INVENTION

The present invention relates in general to a collapsible and variably configurable display stand and more specifically to a display stand which can be quickly erected to serve either as a table having a reducible tabletop size or as a multi-tiered display stand with concentrically arranged shelves.

BACKGROUND OF THE INVENTION

There are numerous occasions, such as trade shows or craft fairs, when display equipment must be transported for the purpose of temporarily supporting articles for show or sale. When a novel or particularly appealing display is desired, considerable time and resources are often invested in designing and constructing a suitable support structure that is collapsible and portable. Once these support structures have been used, they are often discarded because they are no longer novel or they are simply too cumbersome to be stored efficiently. Seasonal displays of articles, such as potted plants in churches or merchandise in stores, also require temporary support structures that can be stored once the particular season or event has passed.

There is therefore a need for a display stand that can be configured in numerous different positions and with different combinations of parts such that the stand offers enough versatility to provide enduring usefulness. In addition, the stand should collapse to a compact form and be easily erected without the need for tools.

SUMMARY AND OBJECTS OF THE INVENTION

The present invention is a display stand having a series of concentric support surfaces which can be configured either as a single co-planar support surface or as multiple support surfaces lying in vertically spaced planes. The support surfaces include a center section, supported by at least three legs, and two extensions. The legs are equally spaced from one another and are pivotally connected to a center section of the support surface. A support frame slidably engages the legs and includes locking means for locking the support frame to the legs in a plurality of vertically spaced locations.

The support surfaces can be configured so as to lie in a common plane to form a table top. In this configuration, the first extension releasably engages the center section, and the second extension releasably engages the first extension. Alternately, the support surfaces can be configured to form a multi-tiered support structure in which both extensions rest on the legs in vertically spaced planes relative to the center section.

When the display stand is not in use, the support surfaces are disposed in a single plane and the legs 18 are rotated outwardly against the underside of the support surfaces. Thus, the display stand can be easily and quickly collapsed and erected without any tools. Further, two or more display stands can be joined together in the storage position.

In view of the above, it is an object of the present invention to provide a display stand comprising a center support section and one or more successive extensions which substantially surround the center section.

Another object of the present invention is to provide for supporting the concentric extensions in vertically spaced relationships to the center section to form a multi-tiered display stand.

Another object of the present invention is to provide means for releasably securing the extensions to the center section and to one another such that they are readily separable and also reversible and rotatable with respect to one another.

Another object of the present invention is to provide a vertically adjustable display stand having a plurality of legs which can be secured in any of several related positions.

Another object of the present invention is to provide means for collapsing the stand for storage.

Another object of the present invention is to provide means for supporting the extensions on the legs in a manner that resists any force which tends to tilt the extensions from a horizontal position.

Another object of the present invention is to provide means for joining two or more display stands together in a storage position.

Other objects and advantages of the present invention will become apparent and obvious from a study of the following description and the accompanying drawings, which are merely illustrative of such invention.

DETAILED DESCRIPTION OF THE INVENTION

Figure 1:
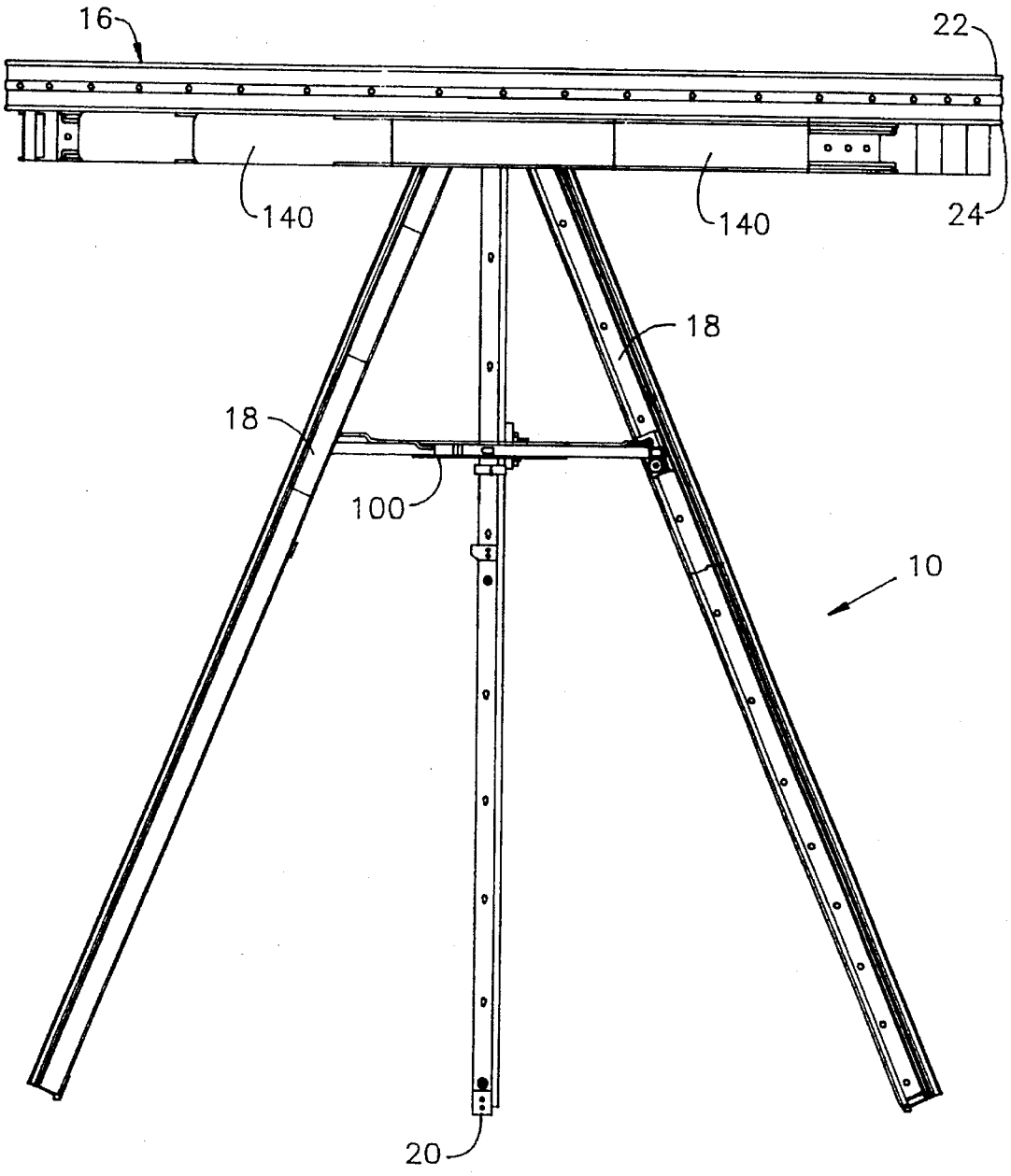
FIG. 1 is an elevation view of the display stand of the present invention configured as a table.
Figure 2:
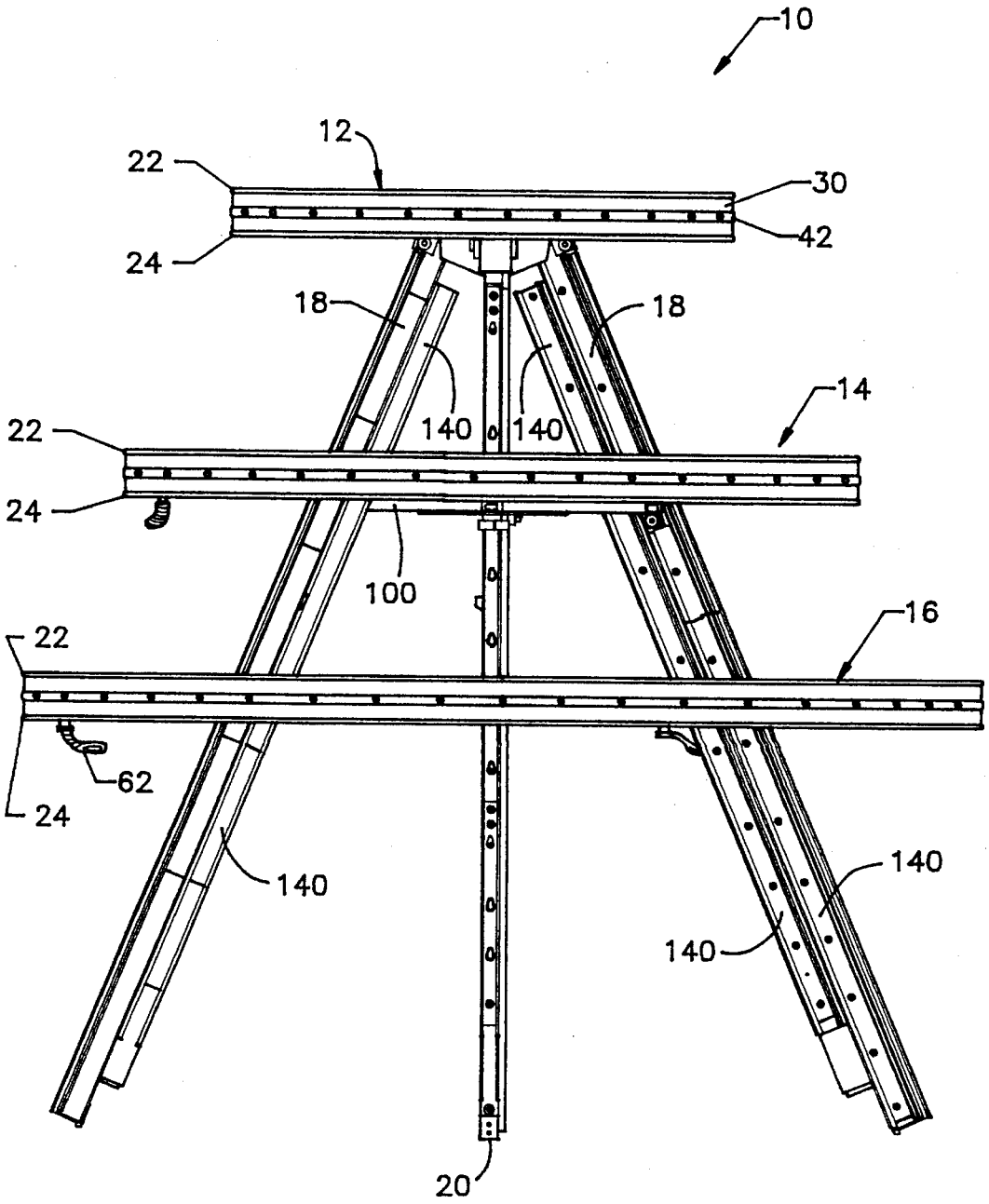
FIG. 2 is an elevation view of the display stand configured as a multi-tiered support stand.

Referring now to the drawings, the display stand of the present invention is shown therein and indicated generally by the numeral 10. The display stand 10 includes a plurality of concentric support surfaces which can be configured to either lie in a common plane to form a table or to lie in separate, spaced apart and parallel planes to form a multi-tiered display stand. FIG. 1 shows the display stand 10 configured as a table. FIG. 2 shows the display stand configured as a multi-tiered display stand.

The display stand 10 includes three concentric support surfaces including a center section 12 and two extensions 14 and 16. While the sections 12, 14, and 16 are shown as being circular, other forms may also be used. In particular, triangular support surfaces 12, 14, and 16 provide great flexibility in the way in which multiple stands can be arranged. The sections 12, 14, and 16 are supported by legs 18 which are pivotally attached to the center section 12. In the disclosed embodiment, there are a total of three legs 18 which function as a tripod. The height of the display stand 10 can be adjusted by moving the legs 18 either closer together or farther apart. By moving the legs closer together, the height of the display stand 10 is increased. Conversely, the height of the display stand 10 is reduced by spreading the legs 18 farther apart. The legs 18 are secured in position by a triangular support frame 100 which is slidably engaged with the legs 18.

Each of the three support surfaces 12, 14, and 16 is constructed in a similar manner. The center section 12, first extension 14, and second extension 16 each include a top laminate 22 and a bottom laminate 24 fastened to opposing sides of radiallyextending support ribs 26. In the center section 12, the support ribs 26 extend radially from a center tube 28 to an outer circumferential band 30. In the extensions 14 and 16, the support ribs 26 extend from a respective inner band 32 or 36 to a respective outer band 34 or 38.

Figure 4:
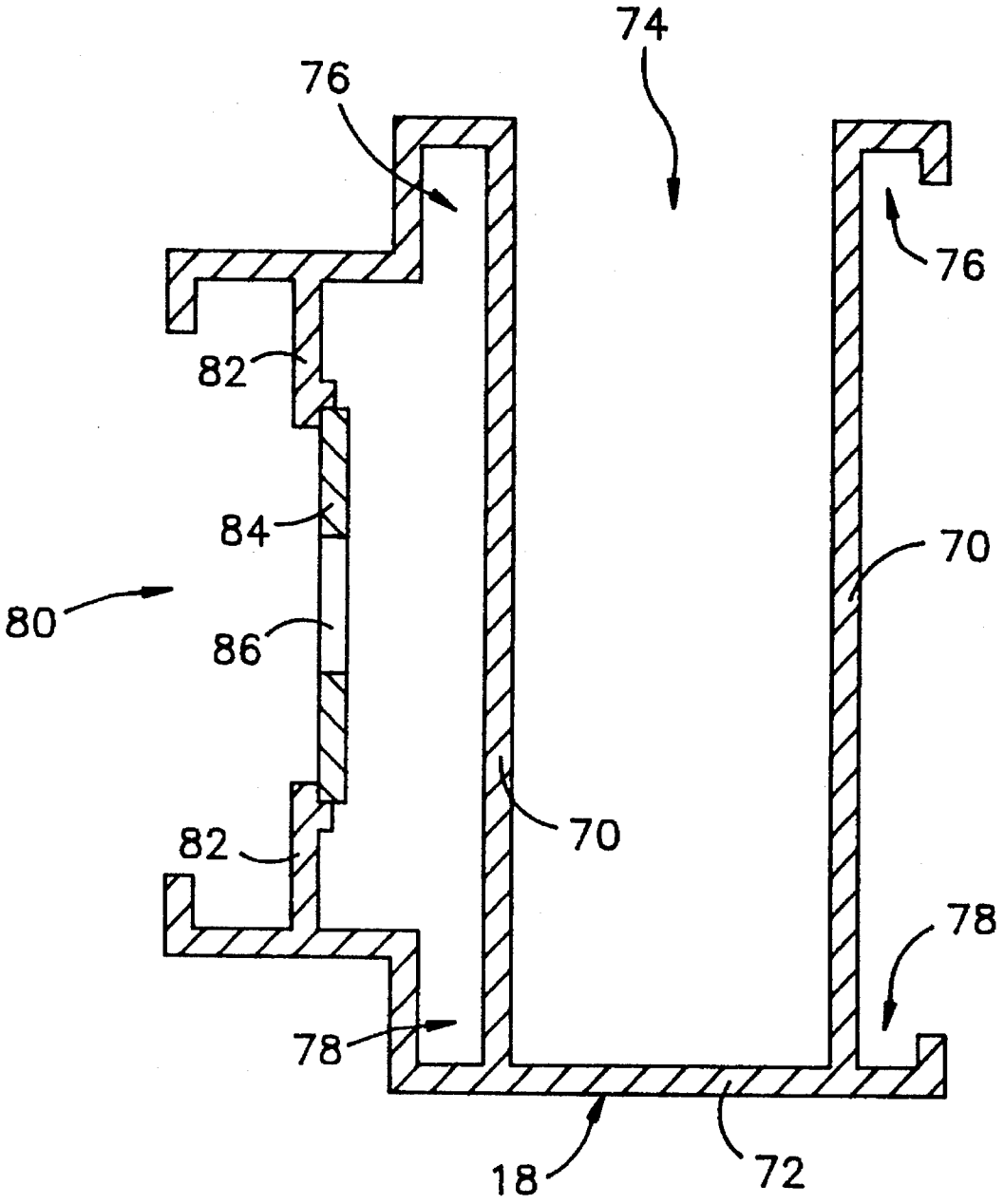
FIG. 4 is a cross-section through one of the legs of the display stand.

The center section 12 is attached to and supported by the legs 18. As shown in FIG. 4, the legs 18 have a generally channeled cross-section. A foot plate 20 is attached to the lower end of each leg 18. Each leg 18 includes generally parallel side walls 70 which are joined at one end by a web 72. The side walls 70 and web 72 define a main channel 74. Connecting channels 76 and 78 are formed at opposing ends of each side wall 70 for joining the legs to similarly formed leg extensions as will be hereinafter described. A locking channel 80 is formed on one side of each leg 18. The support frame 100 is slidably mounted in the locking channel 80 of the legs 18. The locking channel 80 is separated from the adjacent connecting channels 76 and 78 by partition members 82. A perforated bar 84 having a series of longitudinally spaced openings 86 is fixed to the partition members 82 such as by welding.

Figure 5:
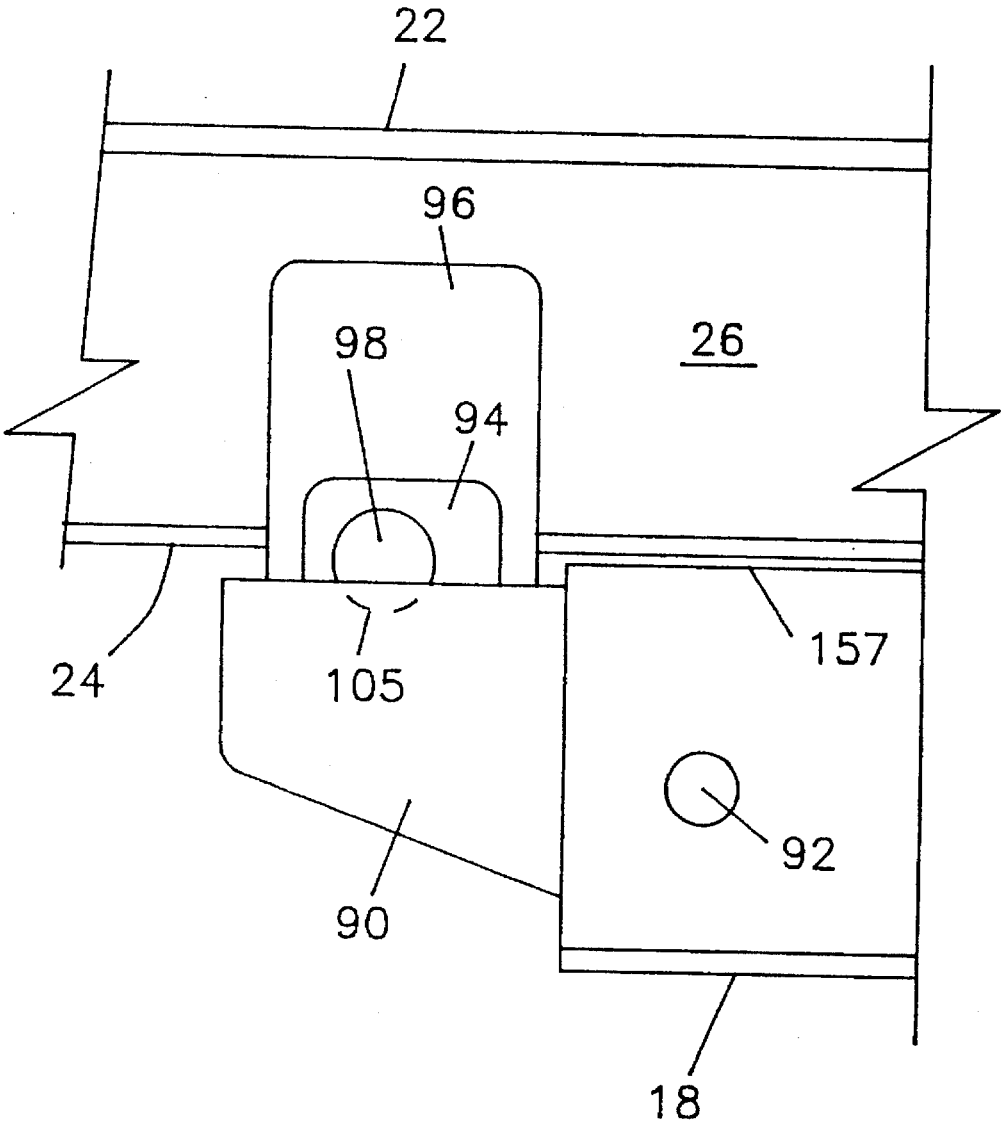
FIG. 5 is a detail showing how a leg is attached to the center section.

Each leg 18 is pivotally connected to a respective support rib 26 of the center section 12 as shown in FIG. 5. A pair of tongues 90 are inserted into the connecting channels 76 and 78 at the upper end of the leg 18 and are secured by a bolt 92 that extends through the leg 18. A pair of first pivot blocks 94 are welded to the outside face of each tongue 90. A pair of second pivot blocks 96 are welded to respective support ribs 26. The first and second pivot blocks are pivotally connected by a pivot pin 98 that fits into matching pin-receiving holes 105 in the pivot blocks 94 and 96. The pin-receiving holes in the first pivot block 94 are partially blocked by the tongue 90. Similarly, the pinreceiving holes in the second pivot block 96 are partially blocked by the support rib 26. Thus, the pivot pin cannot slide out of the pin-receiving holes in the pivot blocks after the legs 18 are attached.

To attach a leg 18 to the center section 12, the pivot pin 98 is inserted into the pinreceiving hole of the second pivot block 96. Next, the pin-receiving holes in the first pivot blocks 94 are fitted over the exposed ends of the pin 98 which protrudes from the second pivot block 96. Finally, the tongues 90 are fitted into the upper and lower connecting channels 76 and 78 in the leg 18 and fastened in place with the bolt 92.

The pivot point of each leg 18 lies in the plane of both the outer surface 157 of the leg 18 and the bottom laminate 24. The pivot point is spaced inwardly from the outer circumference of the center section 12 by a distance equal to the width (w) of one extension. This arrangement assures that the support surfaces 12, 14, and 16 will all be equally spaced irrespective of the angle of the legs 18, as shown in FIG. 20.

Figure 20:
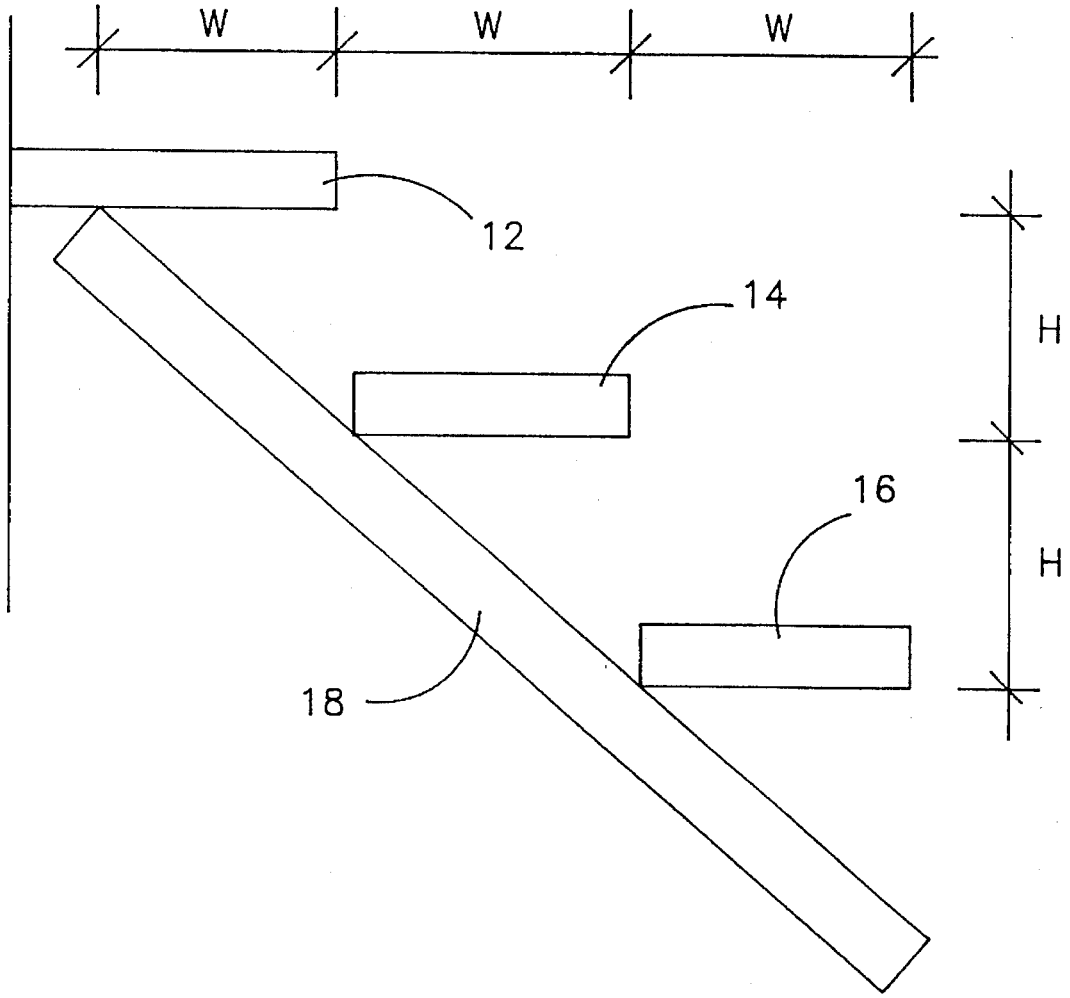
FIG. 20 is a schematic diagram of a display stand.
Figure 21:
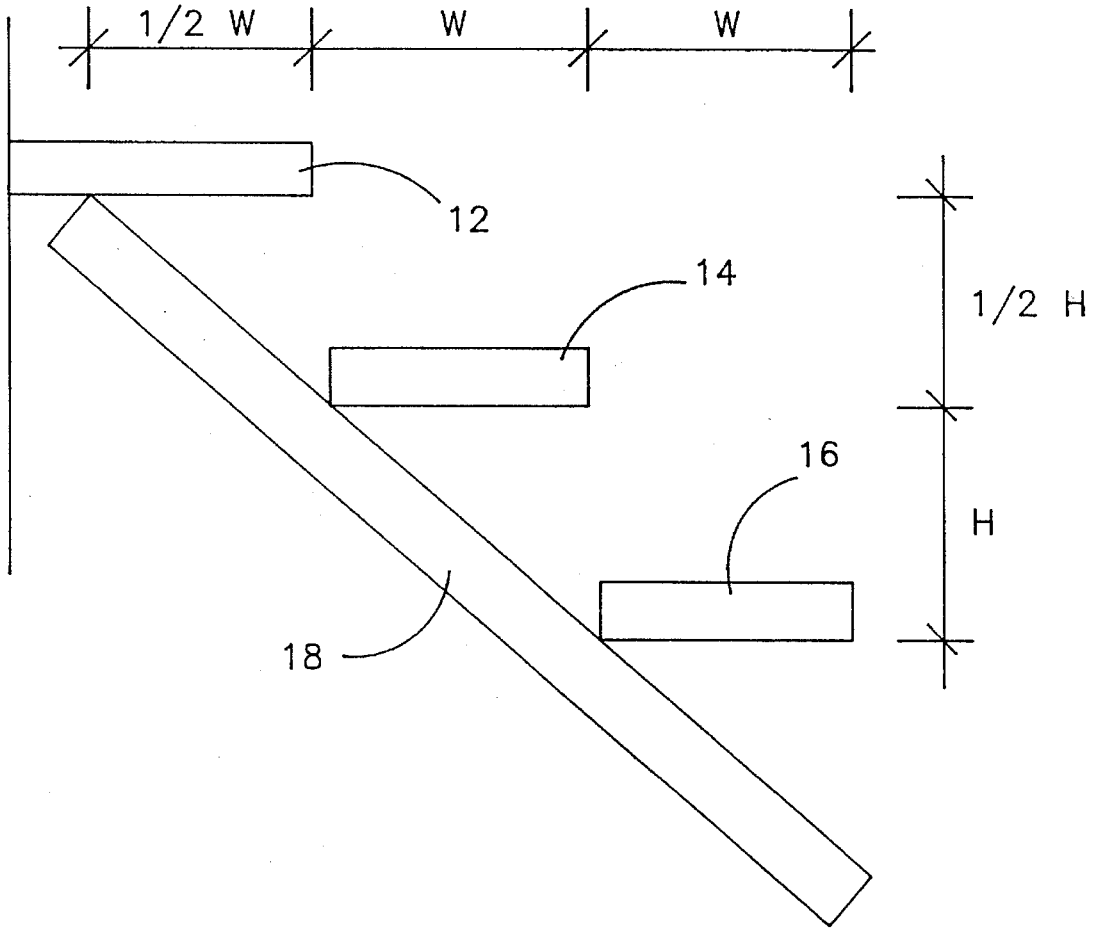
FIG. 21 is a schematic diagram of a second embodiment of the display stand.

FIG. 21 shows an alternate embodiment of the display stand 10 whose dimensions are related to the embodiment shown in FIG. 20. In the second embodiment, the diameter of the center section 12 is smaller than the center section 12 of the first embodiment by an amount equal to the width (w) of an extension 14 or 16. The pivot point of the legs 18 in the second embodiment is spaced from the outer circumference of the center section 12 by an amount equal to one-half the width (w) of one extension 14 or 16. When the display stand 10 of the second embodiment is erected, the vertical distance between the center section 12 and the first extension 14 equals one-half the distance between the two extensions. The extensions 14 and 16 of the larger unit (FIG. 20) can be used with the smaller unit (FIG. 21) to create a five-tier display stand with five equally spaced (in the vertical direction) tiers.

The present invention includes one or more leg extensions 140 for each of the legs 18. The leg extensions 140 are identical in cross-section to the legs 18. Each leg extension 140 is equipped at one end with two thin fiat tongues 142 that fit into the connecting channels 76 and 78 of the leg extension 140. The tongues 142 protrude from the connecting channels of the leg extension 140. The protruding ends of the tongues 142 are inserted into the connecting channels 76 and 78 at the lower end of the legs 18 (or of another leg extension 140).

Figure 11:
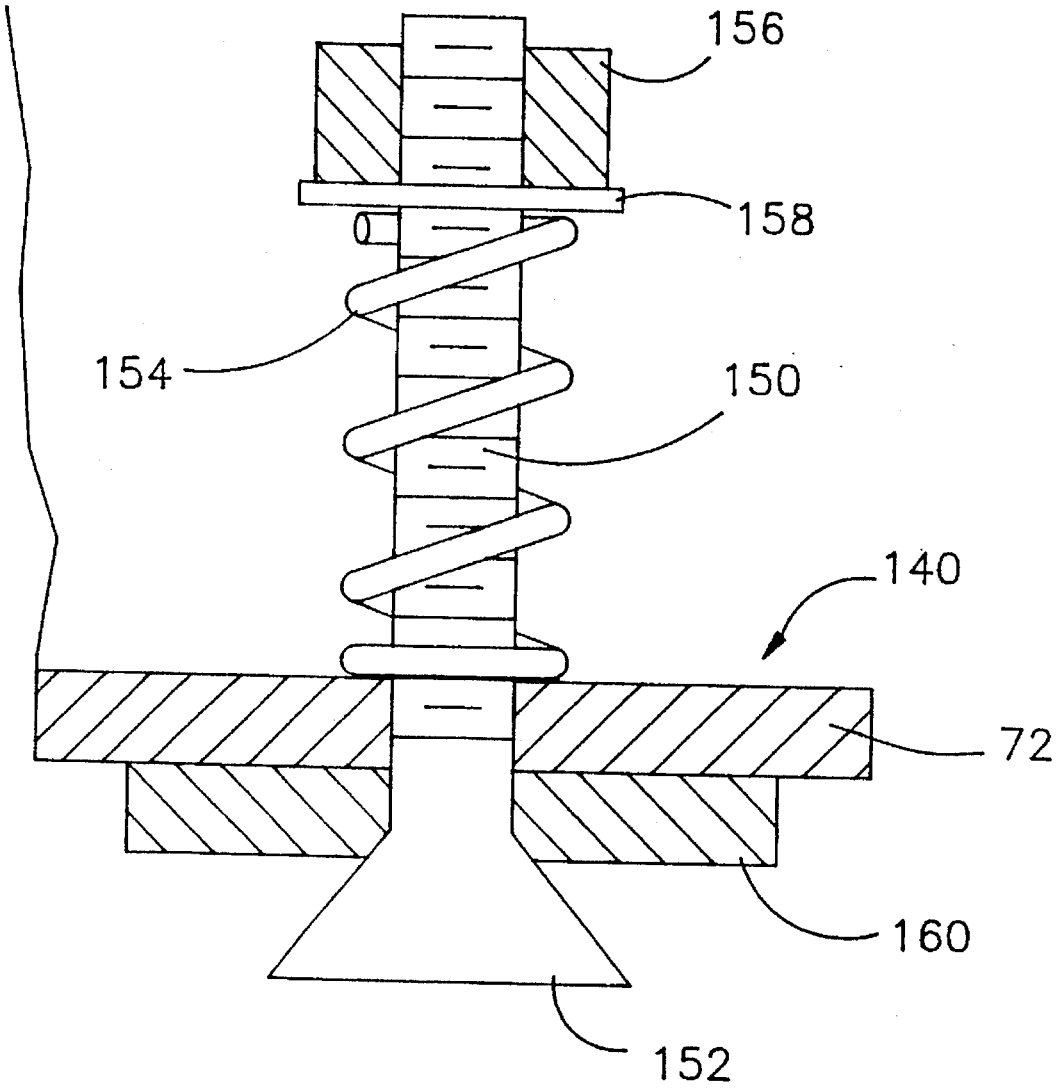
FIG. 11 is a detail section of a leg extension showing the mechanism used to connect the leg extension to the underside of the support surfaces.
Figure 12:
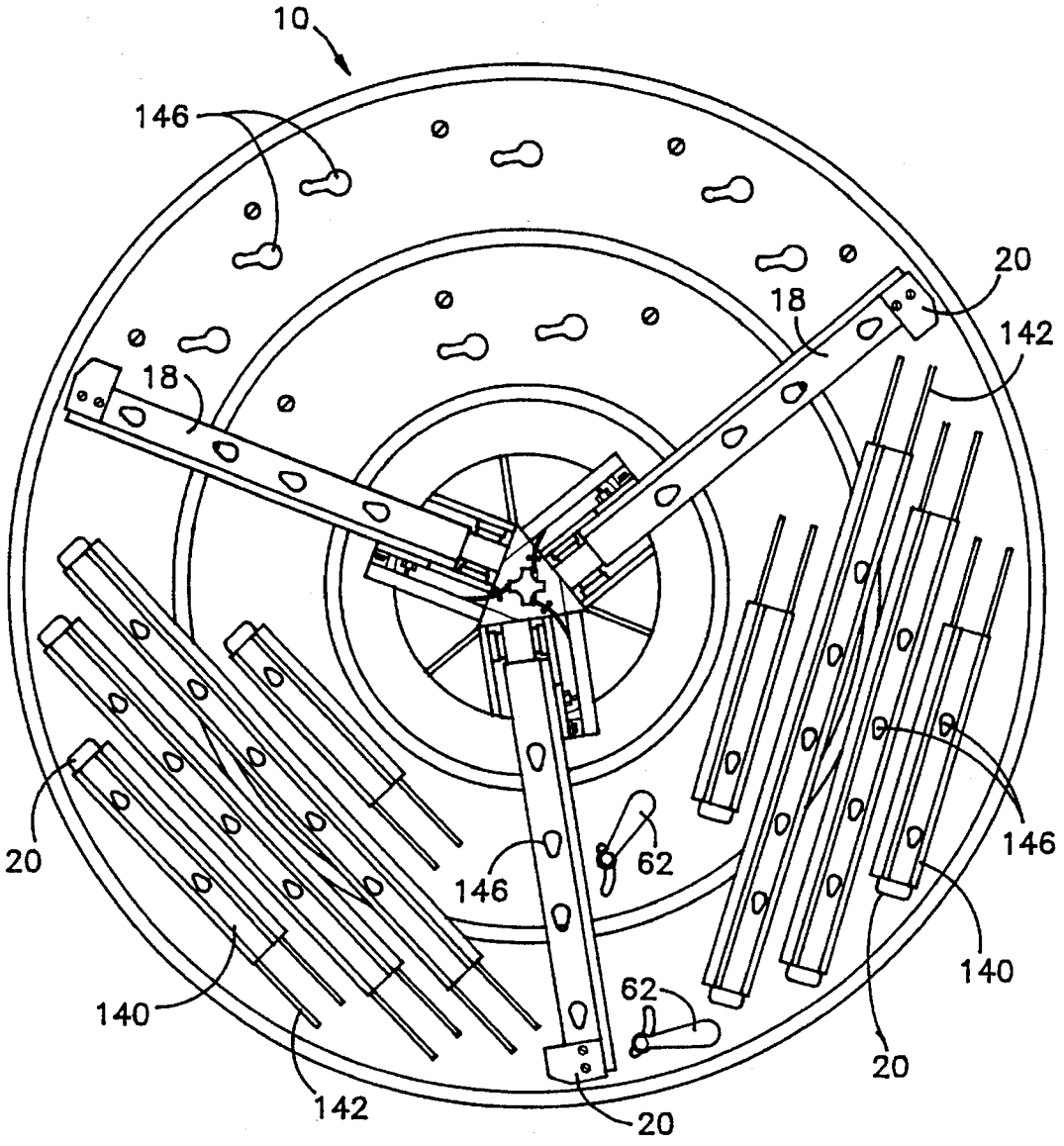
FIG. 12 is a bottom plan view of the display stand folded up for storage.

When the leg extensions 140 are not in use, they can be releasably mounted to the underside of the support surfaces 12, 14, 16, as shown in FIGS. 1 and 12, or to an inside surface of the legs 18, as shown in FIG. 2. A series of oblong slots 146 are formed in the underside of the support surfaces 12, 14, and 16, as well as on the inside surfaces of the legs 18 and leg extensions 140. The leg extensions are fitted with retaining pins 150, shown in FIG. 11, which have an enlarged head portion 152. The pin 150 is threaded at one end and passes through a spacer 160 and an opening in the web 72 of the leg extension 140. A compression spring 154 is inserted over the end of the pin 150 before a washer 158 and lock nut 156 is applied. To attach the leg extensions 140 to the underside of the support surfaces 12, 14, and 16, or to one of the legs 18, the head portion 152 of the pin 150 is inserted into the larger end of the oblong slot 146 and then slid parallel to the surface to engage the head 152 into the narrower end of the oblong slot 146.

The intermediate section 14 and outer section 16 are supported in two ways. First, when the display stand 10 is configured as a table, the first extension 14 is supported from the center section 12 by a latching mechanism. The second extension 16 is similarly supported from the first extension 14. When the display stand 10 is configured as a multitiered support stand, the first extension 14 and center section 16 rest on an outer surface of the legs 18. It should be noted that, if desired, the extension sections 14 and 16 may be flipped upside-down or "reversed" depending on the application in which the display stand 10 is used. Further, the extensions 14 and 16 may be reversed when co-planar or in a vertically spaced relationship with one another.

Figure 6:
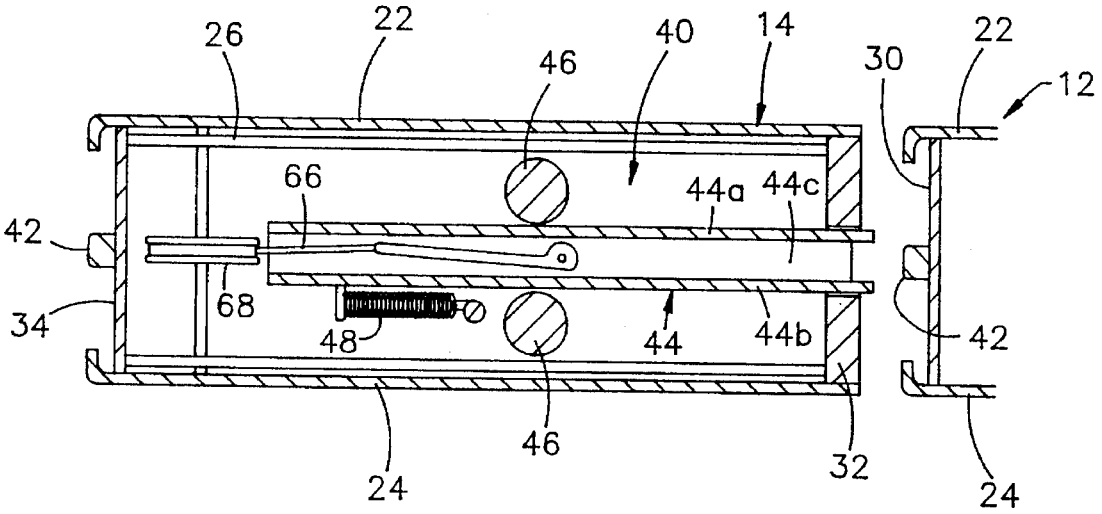
FIG. 6 is a longitudinal section view of the locking mechanism.

Referring now to FIG. 6, there is shown a section view of the locking mechanism 40 for releasably securing the first extension 14 to the center section 12. It is understood that the same locking mechanism 40 is used to releasably secure the second extension 16 to the first extension 14. A bumper 42 is attached to the outer bands 30 and 34, respectively, of the center section 12 and first extension 14. A channel-shaped locking member 44 projects through an opening in the inner band 32 of the first extension 14 to engage the bumper 42 of the center section 12. The locking member 44 includes two spaced apart legs **44*a* and 44*b* which are connected by a vertical web 44*c*. A portion of the vertical web 44*c* is cut away to receive the bumper. The locking member 44 is held between a pair of cylindrical guide members 46 which guide the locking member 44 as the locking member 44 moves inwardly and outwardly. The locking member 44 is biased to an extended or engaged position by a biasing member such as a spring 48**.

Figure 3:
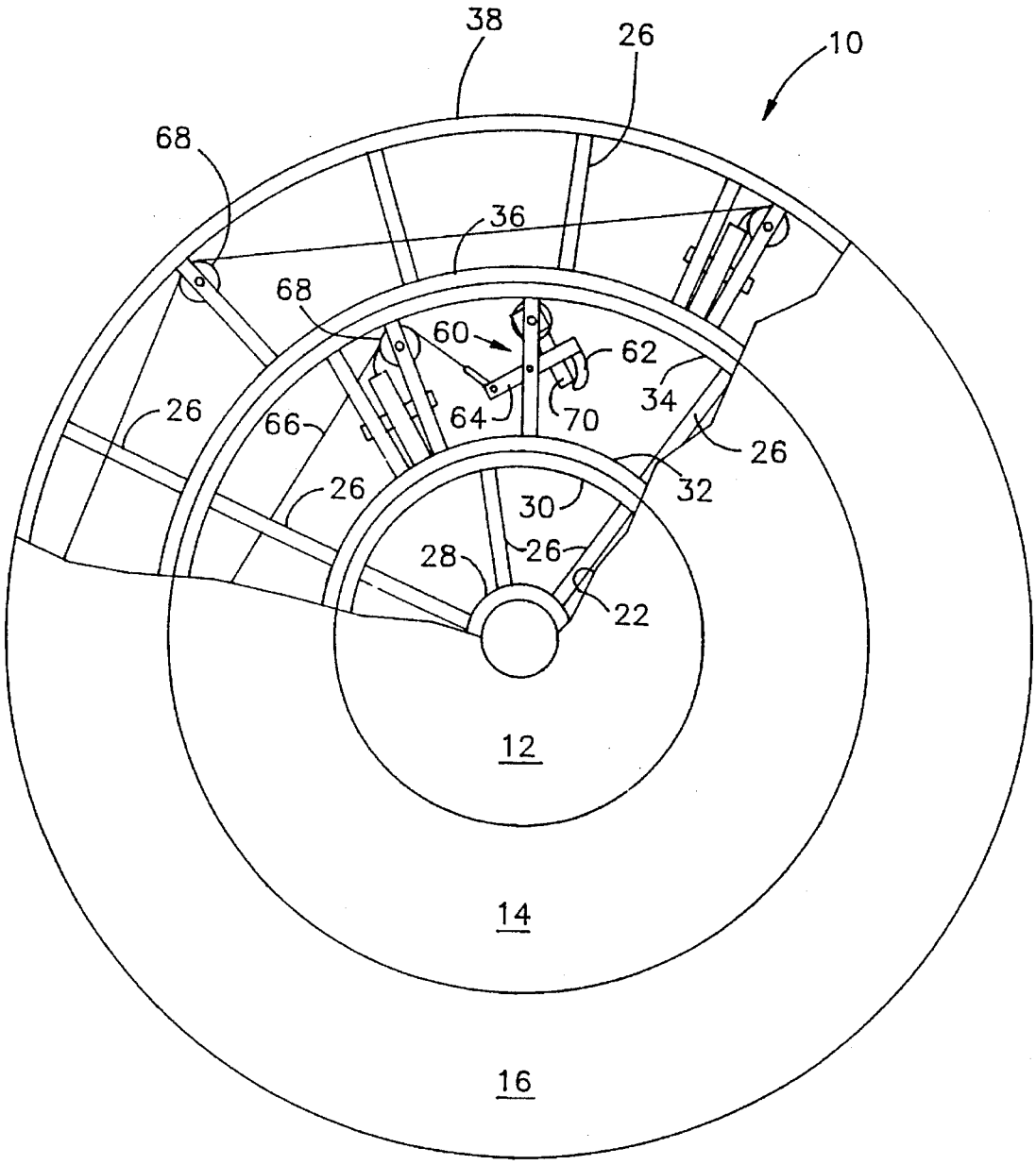
FIG. 3 is a top plan view of the display stand with a portion of the top surface cut away.

A release mechanism 60, shown in FIG. 3, is used to move the locking member 44 to a retracted or disengaged position. The release mechanism 60 comprises a release lever 62 which is connected to a release bar 64. One end of a cable 66 is attached to the release bar 64. The cable 66 extends around a series of pulleys 68 and attaches to each of the locking members 44. When the release lever 62 is pulled outwardly, the cable 66 pulls the locking members 44 to a retracted or disengaged position. A latch 70 holds the release lever 62 in the disengaged position.

Figure 7:
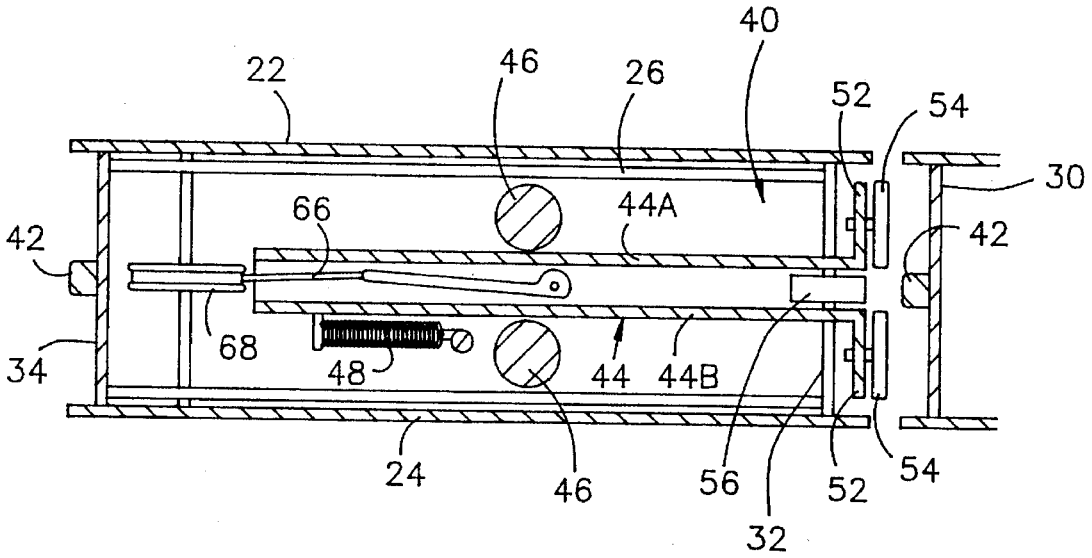
FIG. 7 is a longitudinal section view of an alternate embodiment of the locking mechanism.

FIG. 7 shows an alternate embodiment of the locking mechanism 40. In the alternate embodiment, rollers 54 are mounted to flanges 52 at the outer end of the locking member 44. These rollers 54 engage the upper and lower surfaces of the bumper 42. A third roller 56 is rotatably mounted between the opposed legs **44*a* and 44*b* of the locking member 44 and makes rolling contact with the outer surface of the bumper 42. This embodiment allows the first extension 14 and second extension 16** to rotate.

Figure 8:
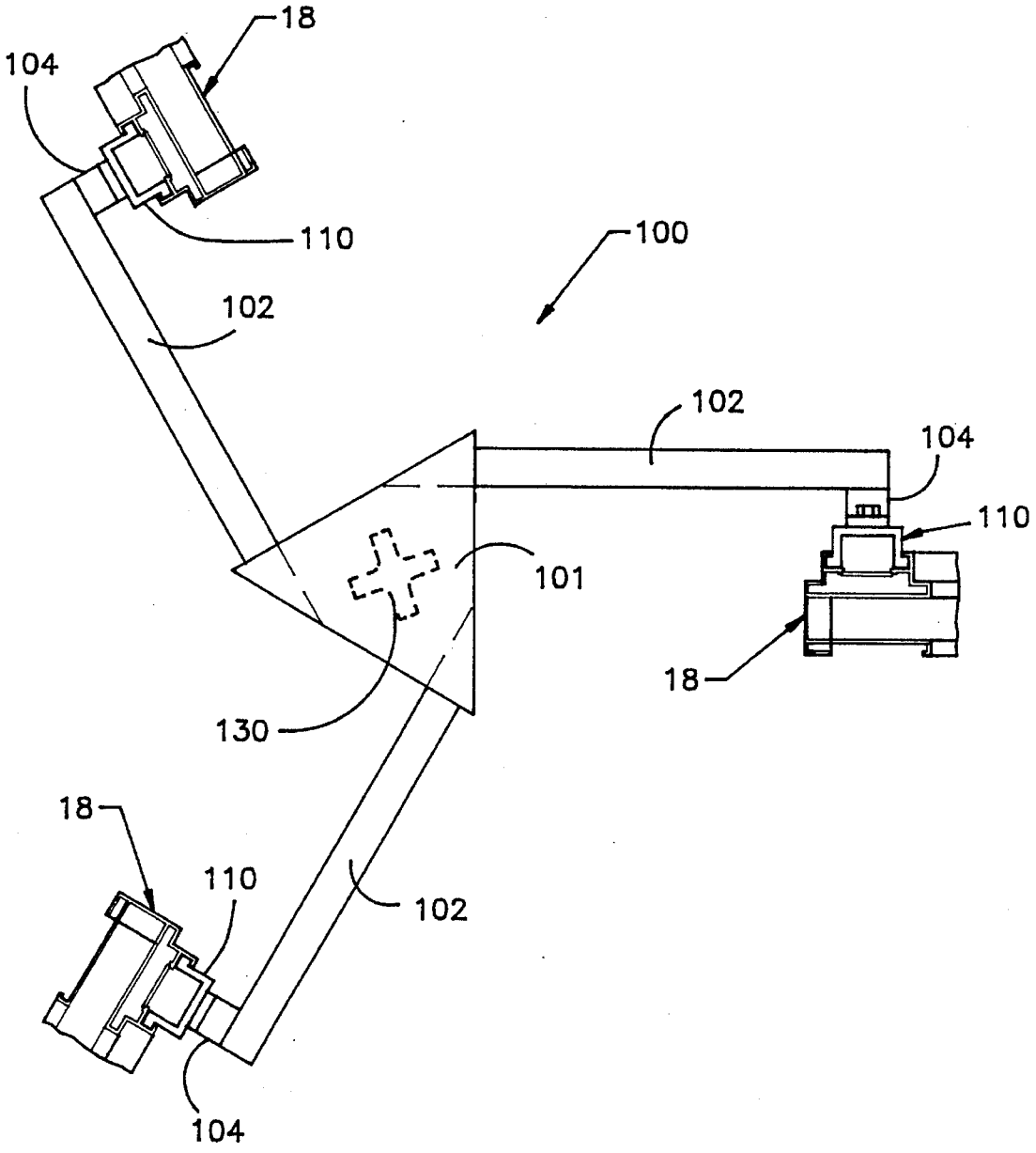
FIG. 8 is a plan view of the support frame.
Figure 9:
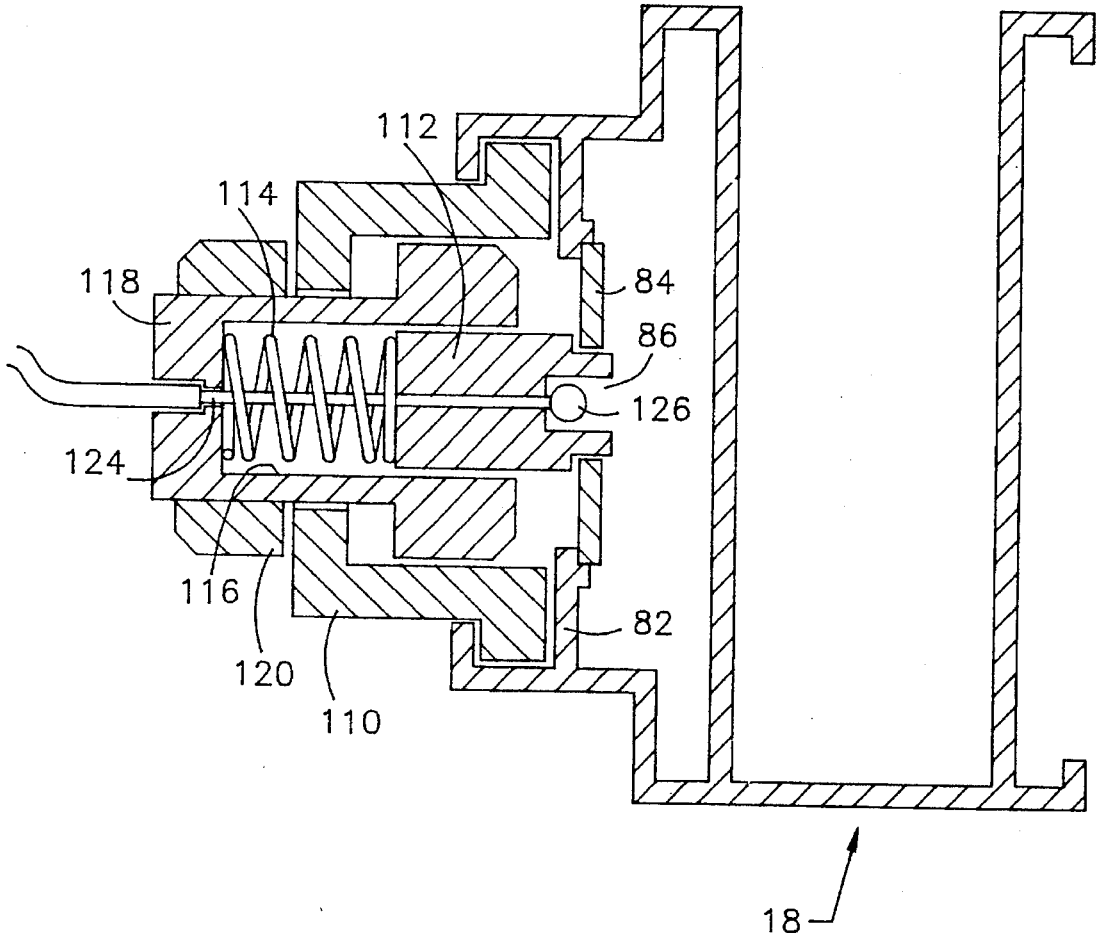
FIG. 9 is a cross-section of a leg showing the slide member in the locking channel.

Referring to FIG. 8, the support frame 100 comprises three locking bars 102 sandwiched between and welded to two triangular plates 101. The locking bars 102 extend outwardly from the triangular plates and are connected at an outer end to a slide member 110 by an L-shaped bracket 104. Each slide member 110 is slidably mounted in the locking channel 80 of a respective leg 18 (or leg extension 140). The slide member 110, as shown in FIG. 9, includes a locking pin 112 which is outwardly biased by a spring 114. The locking pin 112 engages a matching locking hole 86 in the perforated bar 84 which is fixed to the partition member 82 in the leg 18. The locking pin 112 is mounted within an axial hole 116 of a bolt 118 which is secured to the slide member 110 by a nut 120.

Figure 10:
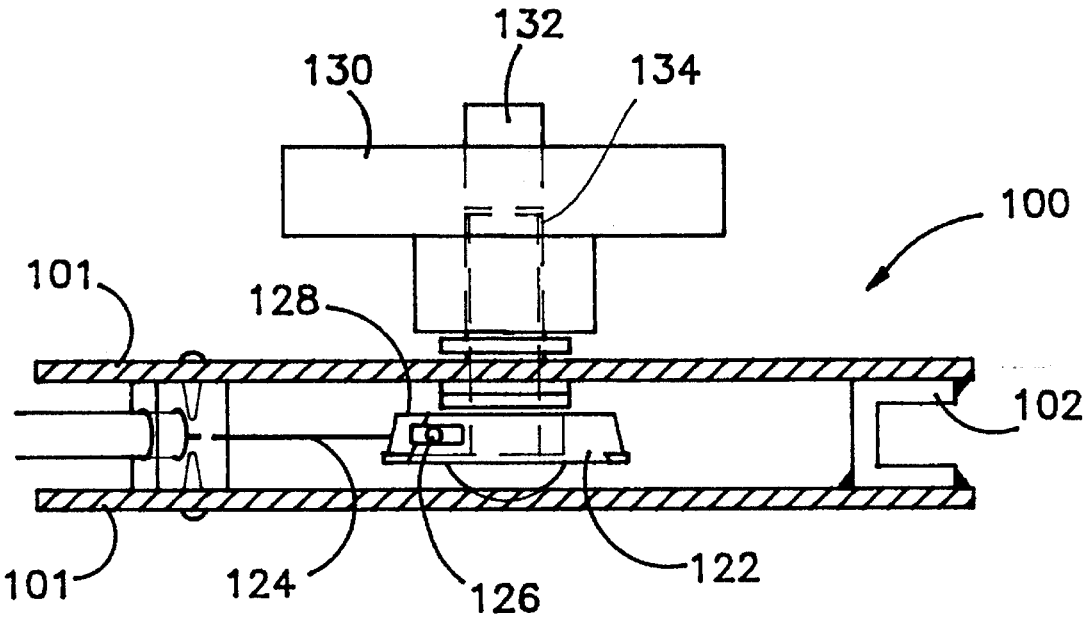
FIG. 10 is a cross-section of the support frame.

The locking pin 112 is moved to a retracted position by a hand knob 130 on the underside of one of the triangular plates 101 (FIG. 10). The knob 130 is connected to a generally triangular actuator plate 122 which is connected by cables 124 to the locking pin 112 in each slide member 110. Each cable 124 includes an enlarged head 126 at each end. The enlarged head 126 at one end of the cable 124 engages with the locking pin 112, while the enlarged head 126 at the opposite end engages a recess 128 in the actuator plate 122. When the hand knob 130 is rotated, the actuator plate 122 pulls the cable 124 causing the locking pins 112 to disengage from the matching openings 86 in the perforated bar 84. Once the locking pins 112 are disengaged, the slide members 110 are free to slide upwardly and downwardly in the locking channels 80 of the legs 18 (or leg extensions 140). As the support frame 100 slides vertically upwardly or downwardly, the legs 18 either move further apart or closer together.

To use the display stand 10, the leg extensions 140 may be attached to the bottom ends of the legs 18, which are pivoted inwardly. The legs 18 are pivoted inwardly by pulling downwardly on the support frame 100. Once the legs 18 are in the desired position, the knob 130 on the support frame 100 is released so that the locking pins 112 engage the matching openings in the perforated bar 84 in the legs 18. The display stand 10 is now in the position shown in FIG. 1. In this position, all of the support surfaces 12, 14, and 16 lie in a common plane to form a table. To separate the individual sections of the support surface, the release lever 62 associated with the outer section 16 is pulled outwardly to disengage the locking members 44. Once the locking members 44 are disengaged from the first extension section 14, the second extension 16 can be lowered until it rests on the outer surfaces of the legs 18. As the second section 16 is lowered, the locking members 44 should preferably be inserted into the main channels 74 of the legs 18. By inserting the locking members 44 into the main channels 74 of the legs 18 (or the leg extensions 140), the extension section is prevented from tipping when an unbalanced load is placed thereon. In a similar fashion, the first extension section 14 is disengaged from the center section 12 and lowered until it rests on the legs 18. Again, the locking members 44 should preferably be inserted into the main channels 74 of the legs 18 as the first extension section 14 is lowered to provide a stable surface.

When the display stand 10 is not in use, the center section 12 and extensions 14 and 16 are arranged so that they lie in a single plane, and the legs 18 are folded against the underside of the support surfaces. The leg extensions 140 are then mounted on the underside of the support surfaces 12, 14, and 16, as shown in FIG. 12.

Figure 14:
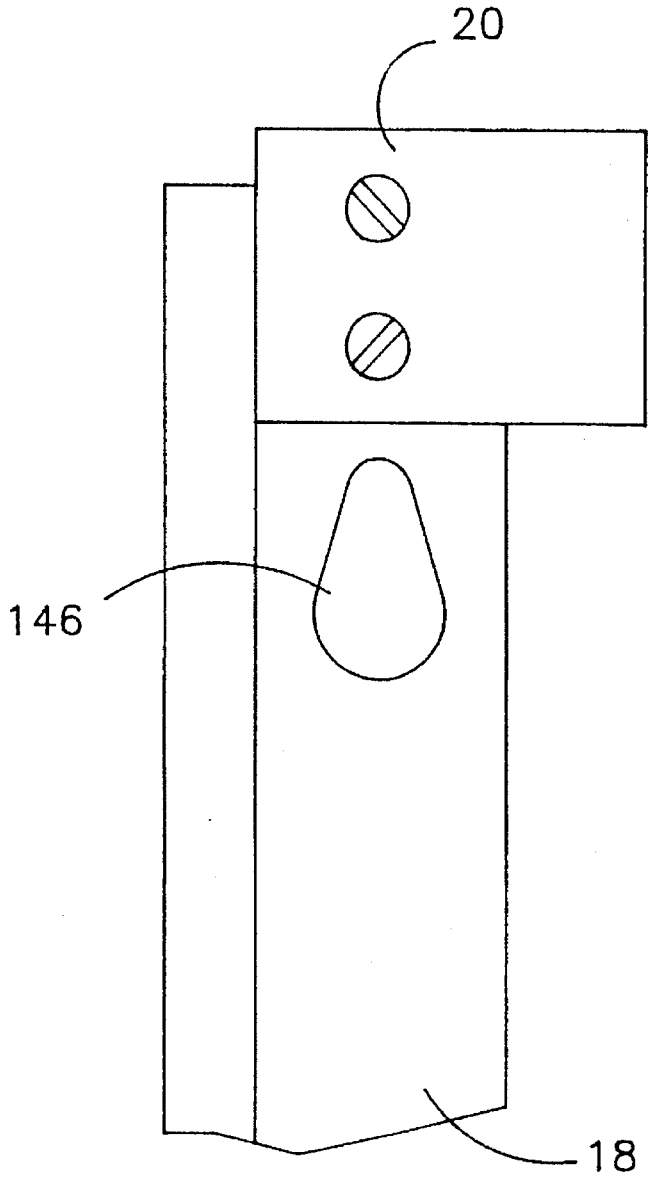
Figure 15:
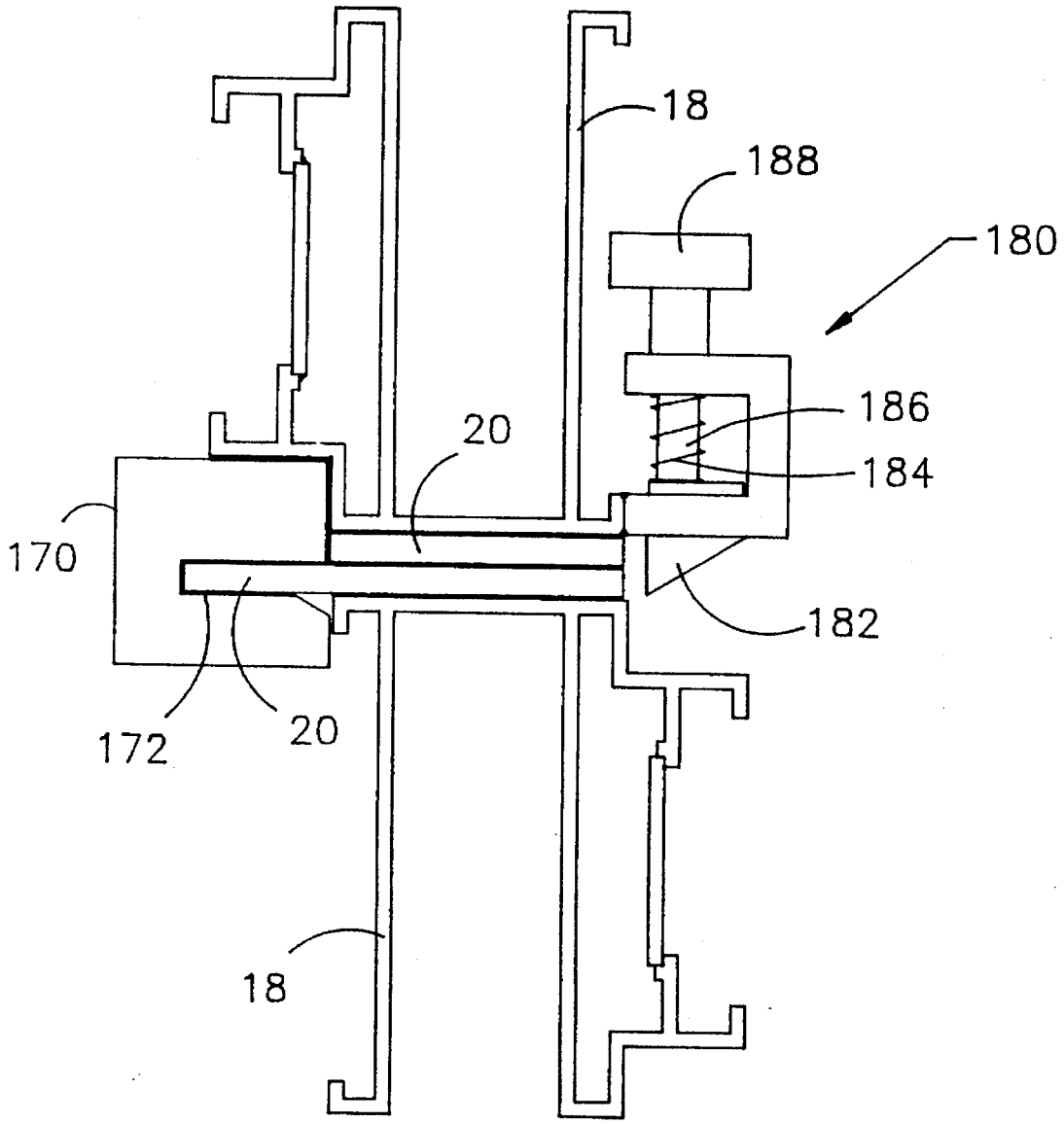
FIG. 15 is a cross-section through the legs of two display stands when the tables are joined together for storage.
Figure 16:
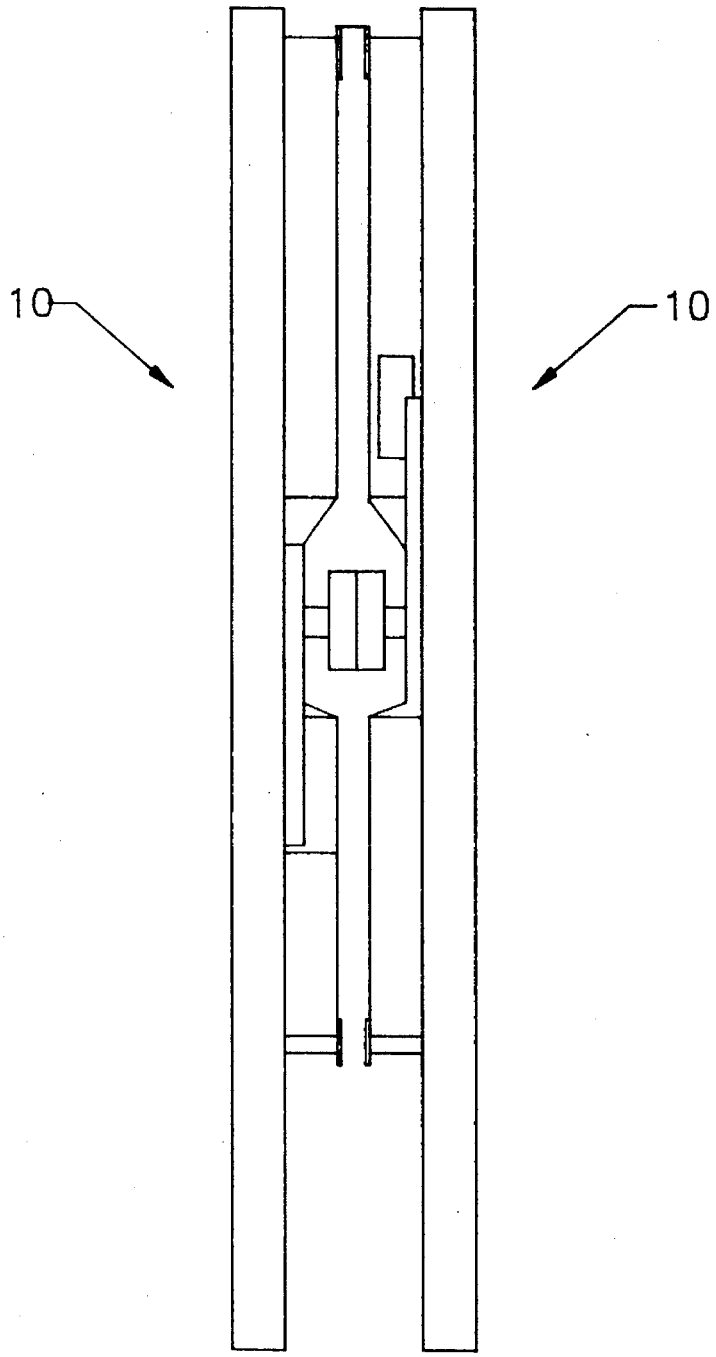
FIG. 16 is a diagrammatic view of two display stands joined together.

Referring now to FIGS. 13 through 16, a method is illustrated for joining two of the display stands 10 in the storage position together. FIG. 16 shows a somewhat diagrammatic elevation view of two display stands 10 connected together for storage. To facilitate this connection, there are slight differences in the way each display stand 10 is constructed. In the following example, one display stand will be referred to as a male stand and the other as a female stand.

In the male display stand, the legs 18 are each equipped with a non-skid foot plate 20 which projects laterally to one side of the leg, as seen in FIG. 14. Also, the male stand is equipped with a pin 132 which projects from the center of the control knob 130 (FIG. 10). The pin 132 is inserted into an opening 134 in the center of the control knob 130. In the female display stand, the pin 132 is removed.

Figure 13:
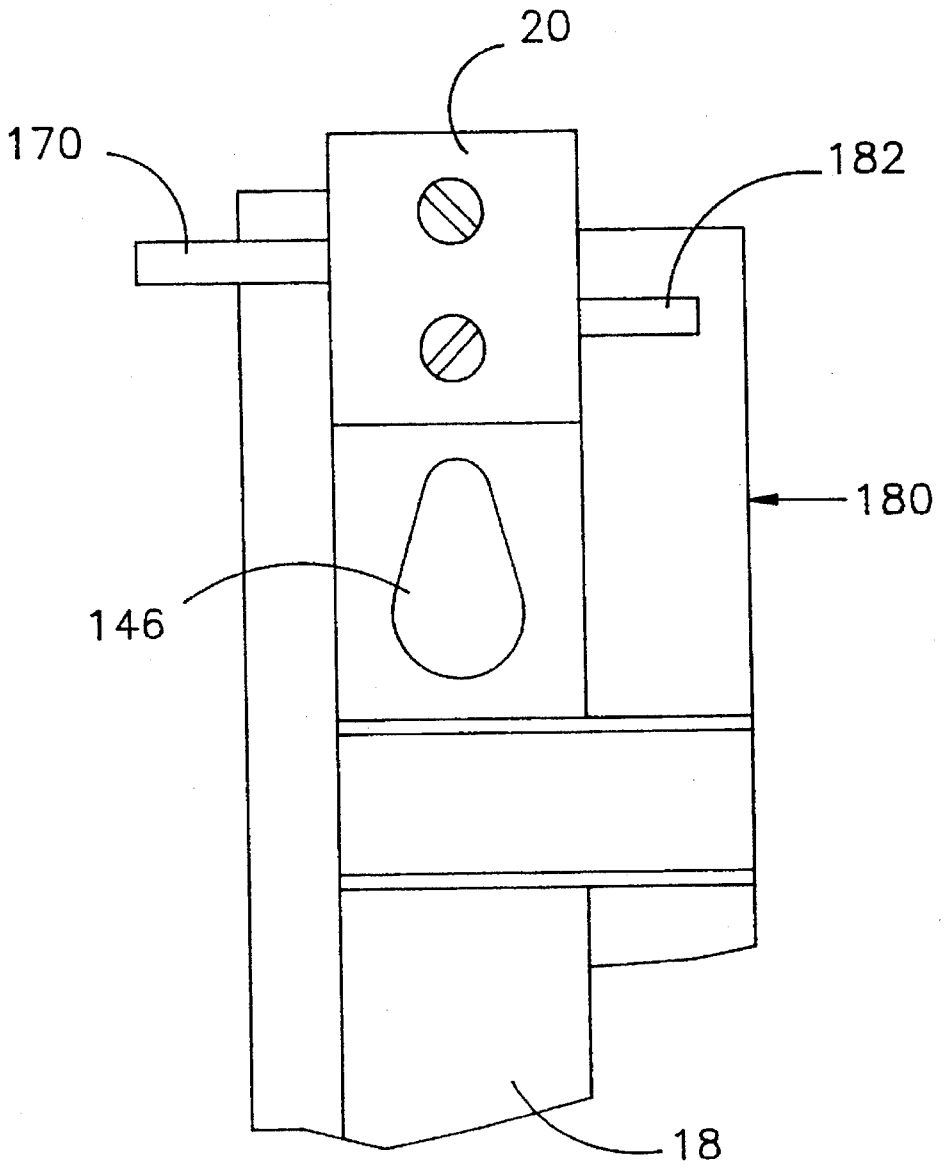
FIGS. 13 & 14 are views of the end of a leg of a display stand.

Each leg 18 of a female display stand 10, shown in FIGS. 13 and 15, includes a connecting plate 170 having a slot 172.

Also, a latch mechanism 180 is attached to one of the legs of the female display stand on the side opposite from the connecting plate 170. The latch mechanism 180 includes a beveled latch bar 182 which is biased by a spring 184 to an extended position. The latch bar 182 is connected by a shaft 186 to a pull tab 188.

To join the two display stands together, as shown in FIG. 16, the pin 132 in the control knob 130 of the male stand is inserted into the corresponding opening 134 in the control knob 130 of the female stand. Next, the display stands 10 are rotated relative to one another about the axis of the pin 132 until the legs 18 of the stands align as shown in FIG. 15. As the display stands 10 are rotated relative to one another, the foot plate 20 of the male stand will engage in the slot 172 of the connecting plate 170 on the female stand. Before engaging the slot 172 in the connecting plate 170, the protruding edge of one of the foot plates 20 of the male stand contacts the beveled edge of the latch bar 182. As the stands are rotated, the latch bar 182 is pressed upward against the biasing pressure of the spring 184. Once the legs 18 are aligned, the pressure of the spring 184 causes the latch 182 to return back to the extended position shown in FIG. 15. In this position, the latch bar 182 prevents the display stands 10 from being inadvertently disconnected. To disconnect the display stands 10, the pull tab 188 of the latching mechanism 180 is lifted to move the latch bar 182 to a retracted position while the stands 10 are rotated relative to one another to disengage the stands.

Figure 17:
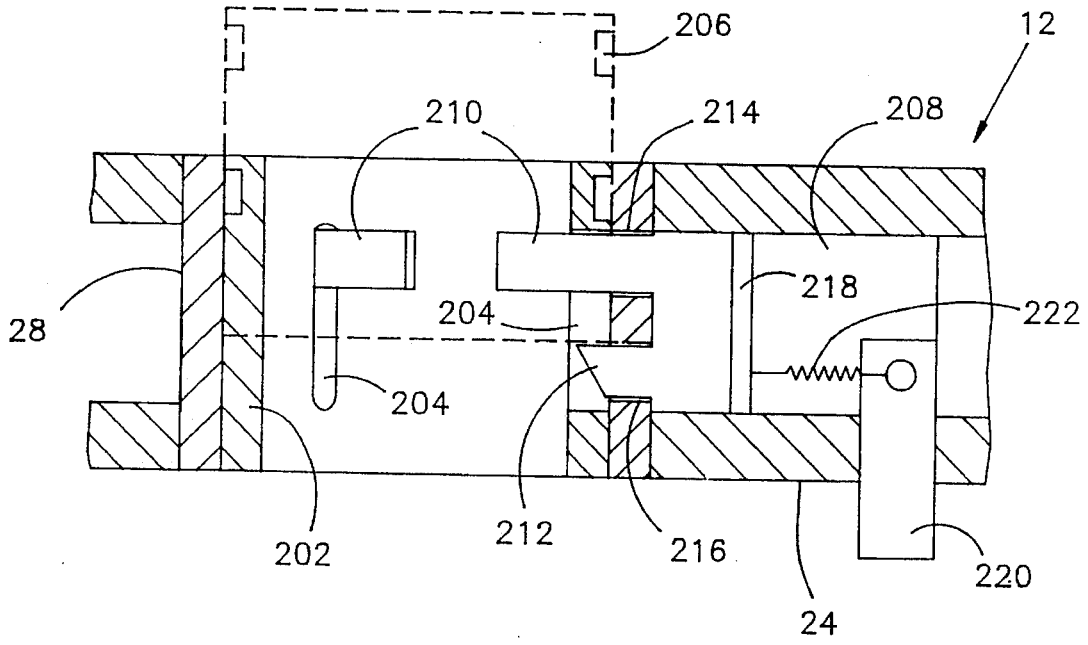
FIGS. 17 & 18 are partial section views of the center section of two display stands showing a alternate mechanism for joining the stands together.
Figure 18:
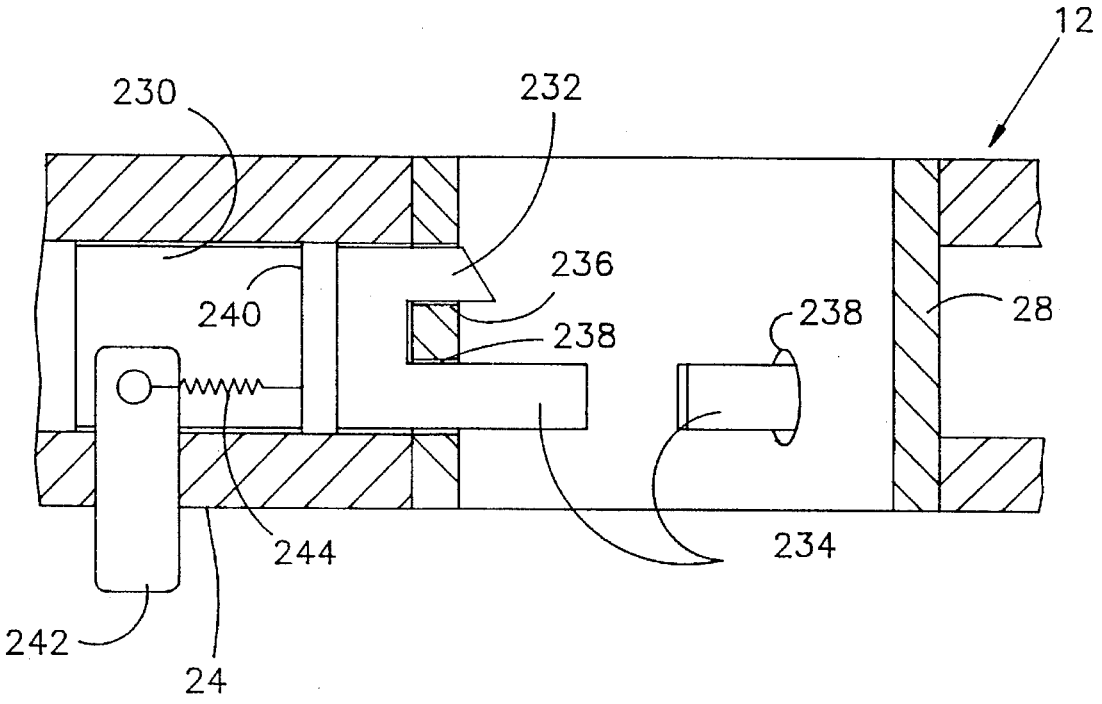
Figure 19:
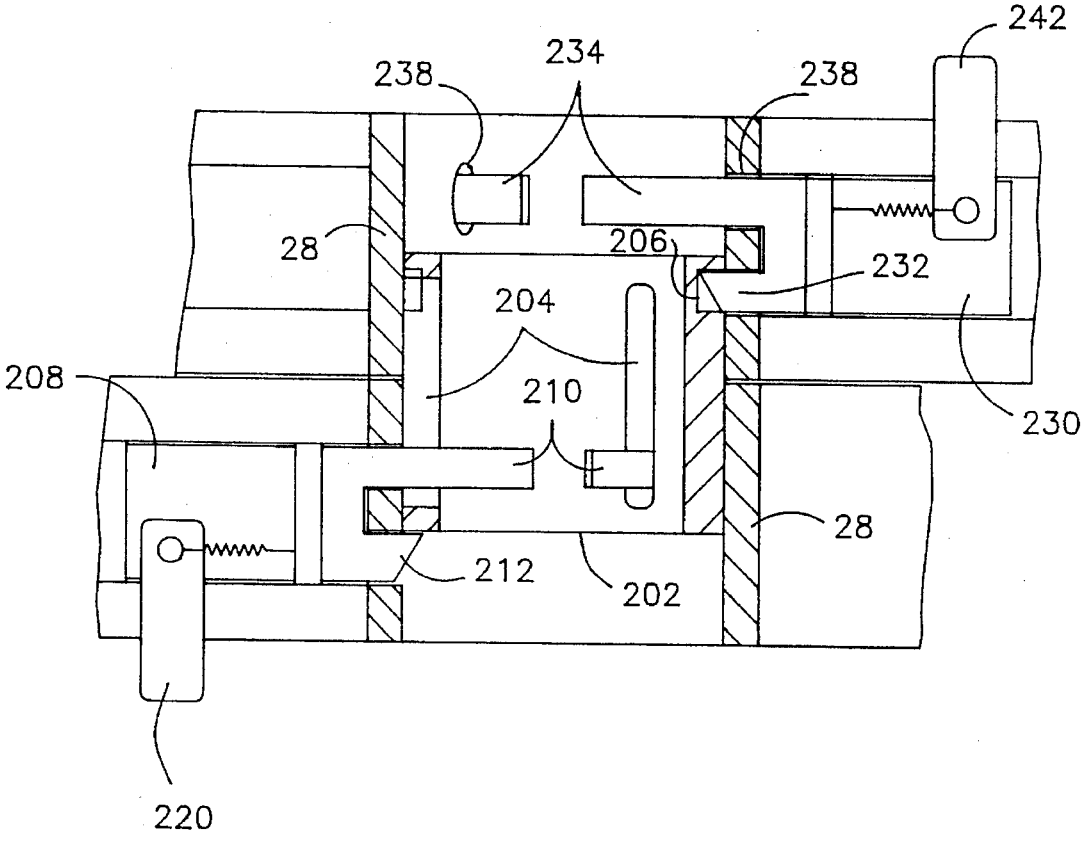
FIG. 19 is a partial section view of the center section of two display stands joined together.

FIGS. 17 through 19 show an alternate method for joining two display stands together in a storage position. To briefly summarize, the center tube 28 of one of the display stands 10 is equipped with an axially movable connecting sleeve 202 which is movable between a retracted position and an extended position. The connecting sleeve 202 can be locked in the extended position. When the connecting sleeve 202 is in the extended position, the protruding end of the connecting sleeve 202 can be inserted into the center tube 28 of another display stand 10. The other display stand is equipped with a latching member which engages the protruding end of the connecting sleeve.

FIG. 17 shows a partial section view toward the middle of the center section 12 of a first display stand equipped with an axially movable connecting sleeve 202. FIG. 18 is a partial section view through a second display stand 10 which can be joined to the first display stand shown in FIG. 17. FIG. 19 shows the display stands of FIG. 17 and 18 joined together.

Referring now to FIG. 17, a connecting sleeve 202 is slidably mounted in the center tube 28 and is movable between a retracted position and an extended position shown in dotted lines in FIG. 17. The connecting sleeve 202 has three axially extending slots 204 which are equally spaced around the circumference of the sleeve 202. A notch 206 (also shown in FIG. 19) is formed in the outer circumference of the connecting sleeve 202. Three slide plates 208 are slidably mounted in respective support ribs 26 of the center section 12. The slide plates 208 are equally spaced around the center tube 28. Each slide plate 208 includes a first projection 210 which extends through an opening 214 in the center tube 28 and a corresponding slot 204 in the connecting sleeve 202. At least one of the slide plates 208 is also equipped with a second projection 212 having a beveled end. The second projection 212 extends through an opening 216 in the center tube 28 so that the beveled end thereof projects slightly from the inner surface of center tube 28. The slide plate 208 is biased to an extended position as shown in FIG. 17 by a spring 222. The spring 222 is connected between the slide plate 208 and a bar 218 having its ends supported in opposing flanges of the support rib 26. A finger tab 220 projects from the slide plate 208 through the bottom laminate 24 of the center section 12. The slide plate 208 is moved to the retracted position by pulling outwardly on the finger tab 220.

Referring now to FIG. 18, the second display stand 10 is also equipped with three equally spaced slide plates 230 which are slidably mounted in respective support ribs 26. Each slide plate 230 includes a first projection 234 which extends through an opening 238 in the center tube 28. At least one of these slide plates 230 includes a second projection 232 which passes through a second opening 236 in the center tube 28. The second projection 232 includes a beveled end which extends slightly beyond the opening 236 in the center tube 28. The slide plate 230 is biased to an extended position by a spring 244 which is connected between a stationary bar 240 and the slide plate 230. The stationary bar 240 has its ends supported in opposing flanges of the support rib 26. A finger tab 242 is connected to the slide plate 230 and projects through an opening in the bottom laminate 24 of the center section 12.

To join the tables illustrated in FIGS. 17 and 18, the connecting sleeve of the first table is moved to an extended position, as shown in FIG. 19. The beveled end of the second projection 212 permits the sleeve to be raised without hindrance but locks the sleeve 202 in the extended position. After the connecting sleeve 202 is locked in the extended position, the protruding end of the connecting sleeve 202 is inserted into the center tube 28 of the second display stand 10. The end of the center tube 28 engages the beveled end of the projection 232 causing the slide plate 230 to move outwardly. When the connecting sleeve 202 is fully inserted into the center tube 28 of the second display stand 10, the projection 232 engages the notch 206 in the outer surface of the connecting sleeve 202. Thus, the display stands 10 are locked together.

To disconnect the display stands, the finger tab 242 of the second stand is pulled outwardly to disengage the second stand from the first stand. After the display stands 10 are disconnected, the finger tab 220 of the first stand is pulled outwardly so that the connecting sleeve 202 can be moved back to the retracted position.

Using the connecting mechanism described in FIGS. 17 through 19, a smaller display stand, as shown in FIG. 21, can be connected to a larger display stand, as shown in FIG. 20. The two larger stands can then be connected together using the mechanism described in FIGS. 13 through 16.

Based on the forgoing it is apparent that the display stand 10 of the present invention can be configured in numerous different ways when used either singly or with other display stands. Additionally, the display stands can be collapsed for storage and transportation.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A multi-shelf display stand comprising:

(a) a plurality of support surfaces including a center section and at least one extension which substantially surrounds said center section;

(b) locking means for releasably securing said extension to said center section so that said center section and said extension are co-planar;

(c) a plurality of legs pivotally attached to the center section and extending angularly downward;

(d) a vertically movable support frame slidably connected to each leg so as to be movable in a vertical direction to pivot the legs inwardly and outwardly to vary the vertical height of the support surface, wherein the support frame is releasably securable at a plurality of locations along the legs to secure the support surface at selected vertical positions; and (e) wherein the extension is movable to a position in vertically spaced relation to said center section and in which said extension rests on said legs.

2. The multi-shelf display stand of claim 1 wherein the support surface is positionable in a storage position wherein the legs extend outwardly adjacent to an underside of said support surface.

3. The multi-shelf display stand of claim 2 wherein the legs extend from the center section and terminate inwardly from an outer edge of the extension when the legs are in the storage position.

4. The multi-shelf display stand of claim 2 further including leg extensions attachable to the legs.

5. The multi-shelf display stand of claim 1 wherein the locking means includes an outwardly-biased locking member disposed along an inner edge of the extension for engagement with an outer edge of the center section.

6. The multi-shelf display stand of claim 5 wherein the legs include a leg channel adapted to receive said locking member when said extension is disposed in a vertically spaced relationship to said center section so that said extension resists tilting when an unbalanced load is placed on said extension.

7. The multi-shelf display of claim 5 further including a manually operable lever for disengaging the locking member from the center section.

8. The multi-shelf display stand of claim 5 wherein the locking means includes rollers mounted to allow rotation of said extension relative to the center section.

9. The multi-shelf display stand of claim 1 including at least two extensions wherein the second extension is releasably secured to and substantially surrounds said first extension.

10. The multi-shelf display stand of claim 1 further including connecting means for connecting the display stand in a storage position in an adjacent, side-by-side relationship With a second multi-shelf display stand.

11. The multi-shelf display stand of claim 4 further including means for mounting said leg extensions to an underside surface of said support surfaces.

12. A display stand comprising:

(a) a center section;

(b) an extension which substantially surrounds said center section;

(c) a plurality of legs attached to said center section;

(d) a plurality of locking members biased towards said center section and disposed generally within said extension, each locking member including a portion that extends from an inner edge of the extension for engaging an outer edge of said center section to releasably secure the extension to the center section; and (e) a release mechanism for moving the locking members to a retracted position away from said center section to disengage the extension from the center section.

13. The display stand of claim 12 wherein said legs are pivotally attached to the center section such that the vertical height of the center section can be adjusted by pivoting said legs inwardly and outwardly relative to a vertical axis of said stand.

14. The display stand of claim 13 further including a support frame slidably connected to said legs by slide members and being vertically movable relative to said center section to pivot said legs inwardly and outwardly.

15. The display stand of claim 14 further including means for locking said legs in a plurality of different angular positions.

16. The display stand of claim 15 wherein said leg-locking means comprises a locking pin on at least one of said slide members for engaging matching holes which are longitudinally spaced along said legs.

17. The display stand of claim 12 further including rollers mounted on said locking members to allow rotation of said extension relative to said center section.

18. The display stand of claim 12 wherein said legs are pivotally attached to said center section so as to fold against an underside of said center section and said extension in a storage configuration.

19. The display stand of claim 18 further including connecting means for connecting the display stand together with a second, equally sized display stand in said storage configuration.

20. The display stand of claim 12 including a plurality of concentric extensions, each of said extensions including biased locking members extending from an inner edge thereof for engaging the outer edge of said center section or an adjacent extension.

21. The display stand of claim 20 further including means for supporting said extensions in a vertically spaced relationship to said center section.

22. The display stand of claim 21 wherein said extensions are supported on said legs.

23. The display stand of claim 22 wherein said legs are pivotally attached to said center section such that the pivot points of said legs are disposed inwardly from the outer edge of said center section by a distance equal to the width of said extensions.

24. The display stand of claim 22 wherein each leg is formed with a leg channel for receiving respective locking members when said extension is supported on said legs so that said extensions resist tilting when an unbalanced load is placed on said extensions.

25. The display stand of claim 21 wherein the extensions are each reversible.

26. The display stand of claim 18 further including connecting means for connecting the display stand together with a second, differently sized display stand in said storage configuration.

27. The display stand of claim 21 wherein the means for supporting said extensions in a vertically spaced relationship to said center section ensure equal vertical spacing between the extensions.

* * * * *